US009886914B2

(12) United States Patent
Wang et al.

(10) Patent No.: US 9,886,914 B2
(45) Date of Patent: Feb. 6, 2018

(54) FLEXIBLE DISPLAY DEVICE DISPOSED IN A HOUSING

(71) Applicants: BOE TECHNOLOGY GROUP CO., LTD., Beijing (CN); HEFEI XINSHENG OPTOELECTRONICS TECHNOLOGY CO., LTD., Hefei, Anuhui (CN)

(72) Inventors: Huan Wang, Beijing (CN); Mookeun Shin, Beijing (CN); Zhizhong Tu, Beijing (CN); Yong Jun Yoon, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 0 days.

(21) Appl. No.: 14/894,672

(22) PCT Filed: Jun. 3, 2015

(86) PCT No.: PCT/CN2015/080664
§ 371 (c)(1),
(2) Date: Nov. 30, 2015

(87) PCT Pub. No.: WO2016/107071
PCT Pub. Date: Jul. 7, 2016

(65) Prior Publication Data

US 2016/0358552 A1 Dec. 8, 2016

(30) Foreign Application Priority Data

Dec. 31, 2014 (CN) ..... 2014 1 0853030

(51) Int. Cl.
*G09G 5/02* (2006.01)
*G09G 3/34* (2006.01)
(Continued)

(52) U.S. Cl.
CPC ..... *G09G 3/342* (2013.01); *G09F 9/301* (2013.01); *G09G 3/20* (2013.01); *G09G 3/3622* (2013.01);
(Continued)

(58) Field of Classification Search
CPC ..... G09G 3/342
(Continued)

(56) References Cited

U.S. PATENT DOCUMENTS

2005/0176470 A1 8/2005 Yamakawa
2008/0150885 A1 6/2008 Overwijk et al.
(Continued)

FOREIGN PATENT DOCUMENTS

CN 1833194 A 9/2006
CN 101420524 A 4/2009
(Continued)

OTHER PUBLICATIONS

Second Chinese Office Action dated Jan. 17, 2017; Appln. No. 201410853030.7.
(Continued)

*Primary Examiner* — Long D Pham
(74) *Attorney, Agent, or Firm* — Ladas & Parry LLP

(57) ABSTRACT

A display device. The display device comprises: a housing (01) having an outlet (06); a flexible display panel (02) located inside the housing (01). At least a portion of the flexible display panel (02) can be pulled out from the outlet (06), and in a case where the flexible display panel (02) is pulled out, a region located outside the housing (01) is a front end region (02*a*) of the flexible display panel (02), and
(Continued)

a region located inside the housing (01) is a rear end region (02*b*) of the flexible display panel (02). An extending direction from the front end region (02*a*) to the rear end region (02*b*) is a direction from front to rear of the flexible display panel (02). The display device further comprises a detection calculation unit (03) configured to detect and calculate an area of the front end region (02*a*); and a controller signally connected with the detection calculation unit (03) and the flexible display panel (02), and configured to receive the area of the front end region (02*a*) output from the detection calculation unit (03) and control only the front end region (02*a*) displaying images.

16 Claims, 5 Drawing Sheets

(51) Int. Cl.
*G09G 3/36* (2006.01)
*G09G 3/20* (2006.01)
*G09F 9/30* (2006.01)

(52) U.S. Cl.
CPC ... *G09G 3/3648* (2013.01); *G09G 2300/0486* (2013.01); *G09G 2320/041* (2013.01); *G09G 2320/046* (2013.01); *G09G 2330/045* (2013.01); *G09G 2360/145* (2013.01); *G09G 2380/02* (2013.01)

(58) Field of Classification Search
USPC ..... 345/694
See application file for complete search history.

(56) References Cited

U.S. PATENT DOCUMENTS

| | | | | |
|---|---|---|---|---|
| 2009/0109131 | A1 | 4/2009 | Wang et al. | |
| 2010/0056223 | A1 | 3/2010 | Choi et al. | |
| 2011/0084898 | A1 | 4/2011 | Ebbeling et al. | |
| 2013/0033476 | A1* | 2/2013 | Dean | G09G 3/344 345/211 |
| 2013/0036638 | A1* | 2/2013 | Kwack | G06F 1/1652 40/515 |
| 2013/0314387 | A1 | 11/2013 | Kwack et al. | |
| 2013/0314762 | A1 | 11/2013 | Kwack et al. | |
| 2014/0194165 | A1* | 7/2014 | Hwang | G06F 1/1677 455/566 |

FOREIGN PATENT DOCUMENTS

| | | | |
|---|---|---|---|
| CN | 101853613 | A | 10/2010 |
| CN | 102043444 | A | 5/2011 |
| CN | 103426366 | A | 12/2013 |
| CN | 103426384 | A | 12/2013 |
| CN | 203759584 | A | 8/2014 |
| CN | 104505005 | A | 4/2015 |
| CN | 204315195 | A | 5/2015 |
| WO | 2008/140308 | A1 | 11/2008 |

OTHER PUBLICATIONS

International Search Report and Written Opinion both dated Sep. 23, 2015; PCT/CN2015/080664.
First Chinese Office Action dated Aug. 18, 2016; Appln. No. 201410853030.7.
The Third Chinese Office Action dated Jun. 16, 2017; Appln. No. 201410853030.7.

* cited by examiner

FLEXIBLE DISPLAY DEVICE DISPOSED IN A HOUSING

FIELD

The present invention relates to a display device.

BACKGROUND

The current so-called "rigid" display devices are mainly Liquid Crystal Display (LCD). Such displays inevitably have certain weight and volume, which cannot be bent and need to be placed in a fixed frame, thus ease of use is limited.

Unlike the indeformable "rigid" display device described above, a flexible display device has an essential member of a flexible display panel. A flexible display panel typically refers to a display panel with a display unit formed on a flexible substrate such as polyimide and having flexibility. Since the flexible display panel has the characteristics such as thin, bendable and low power consumption, and the deformation enables reduced volume for easy carrying, therefore there is a great application potential. A conventional flexible display panel typically includes a housing and a panel wrapped inside the housing, and one end of the panel is pulled out from the housing for viewing in use.

However, in some cases, it is only required to pull a portion of the flexible display panel out from the housing. Since the entire display area of the flexible display panel is in an active display state at this time, a portion of the flexible display panel located inside the housing in the wrapped state is also in the active display state. In this case, since the panel located inside the housing is in the wrapped state, the wrapped flexible panel in the active display state will cause heat accumulation inside the housing, leading to a higher temperature inside the housing. If the panel is in a high temperature condition for a long time, the operation performance of the panel will be deteriorated and thus shortening the lifetime of the panel.

SUMMARY

The present invention provides a display device which can improve the lifetime of the flexible display panel.

According to one aspect, a display device in embodiments of the present invention comprising: a housing having an outlet; a flexible display panel located inside the housing, wherein at least a portion of the flexible display panel can be pulled out from the outlet, and in a case where the flexible display panel is pulled out, a region located outside the housing is a front end region of the flexible display panel, and a region located inside the housing is a rear end region of the flexible display panel, an extending direction from the front end region to the rear end region is a direction from front to rear of the flexible display panel; a detection calculation unit configured to detect and calculate an area of the front end region; and a controller signally connected with the detection calculation unit and the flexible display panel, and configured to receive the area of the front end region output from the detection calculation unit and control only the front end region displaying images.

In an example, the flexible display panel includes at least one discrete mark region disposed along the direction from front to the rear of the flexible display panel; the detection calculation unit includes a detection unit disposed at the outlet, and the detection calculation unit determines the area of the front end region according to a number of the mark regions detected by the detection unit.

In an example, the mark region is at least one luminant region formed on the flexible display panel by control of the controller, and the luminant regions and non-luminant regions separating the luminant regions have a total number of at least three; the detection unit is a light intensity detection unit configured to detect intensity of light.

In an example, in a case where an Nth luminant region opposes the light intensity detection unit directly, the light intensity detection unit detects an optical signal of the Nth luminant region, the detection calculation unit determines that the Nth luminant region is located at the outlet, and the detection calculation unit determines that a flexible display panel region in front of the Nth luminant region is the front end region, and feeds the area information of the front end region to the controller; in a case where an Nth non-luminant region opposes the light intensity detection unit directly, the light intensity detection unit detects an optical signal corresponding to the Nth non-luminant region, the detection calculation unit determines that the Nth non-luminant region is located at the outlet, and the detection calculation unit keeps the area information of the front end region detected at a previous time; where N is a positive integer.

In an example, a width of the luminant regions is equal to a width of the non-luminant regions in the direction from front to rear of the flexible display panel.

In an example, a width of the luminant region is smaller than a width of the non-luminant region in the direction from front to rear of the flexible display panel in a case where the width of the luminant region and the width of the non-luminant region abutting the luminant region have a constant sum.

In an example, a region of the flexible display panel pulled out from the outlet firstly is the luminant region.

In an example, the flexible display panel is an active light emitting type flexible display panel or a passive emitting type flexible display panel.

In an example, the flexible display panel is the passive emitting type flexible display panel, and the display device further includes a light source disposed near the light intensity detection unit and emitting lights which are not incident onto the light intensity detection unit directly, and the luminant region reflects the lights from the light source, and the non-luminant region transmits the lights from the light source.

In an example, the flexible display panel is a passive matrix type flexible display panel with a column scanning mode.

In an example, the detection calculation unit is located inside the housing, and the controller is located outside the housing.

In an example, in a case where the detection calculation unit determines that a region of the flexible display panel in front of the Nth luminant region is the front end region, the controller further controls a (N+1)th luminant region after the Nth luminant region to be luminant.

In an example, the controller is configured to control at most two luminant regions in a luminant state.

In an example, in a case where the detection calculation unit determines that the region of the flexible display panel in front of the Nth luminant region is the front end region, the controller is configured to control only the Nth luminant region and the (N+1)th luminant region after the Nth luminant region to be luminant.

In an example, the controller is configured to control all the luminant regions on the flexible display panel in a luminant state when the display device has been just powered on.

By using the display device according to the embodiments of the present invention, the detection calculation unit can detect the area size of the front end region of the display panel outside the housing and feed the area information corresponding to the front end region back to the controller. The controller can control only the front end region of the flexible display panel to display images based on the information, and control the rear end region of the flexible display panel to keep an original state in which no image is displayed. In this case, the temperature of the rear end region is low with less heat generation, so that the temperature within the housing is low. Thus, the operation performance of the panel will not be affected or less affected and the lifetime of the panel is lengthened.

Compared with prior art, during operation of the display device, since the rear end region of the display panel located inside the housing is the regions with no images displayed, the temperature of the region is low and less heat is generated, and the temperature inside the housing is also low. Therefore, the rear end region of the display panel wrapped inside the housing would not cause heat accumulation. The operation performance of the panel will not be deteriorated by heat accumulation, and the lifetime of the display panel could be extended.

BRIEF DESCRIPTION OF THE DRAWINGS

In order to explain the technical solution in the embodiments of the present invention more clearly, the accompanying drawings needed to be used in the embodiments will be briefly introduced below. It is obvious that the drawings described below are only some embodiments of the present invention, and other drawings can also be obtained based on these drawings for those skilled in the art without any inventive work.

DETAILED DESCRIPTION

Figure 1:
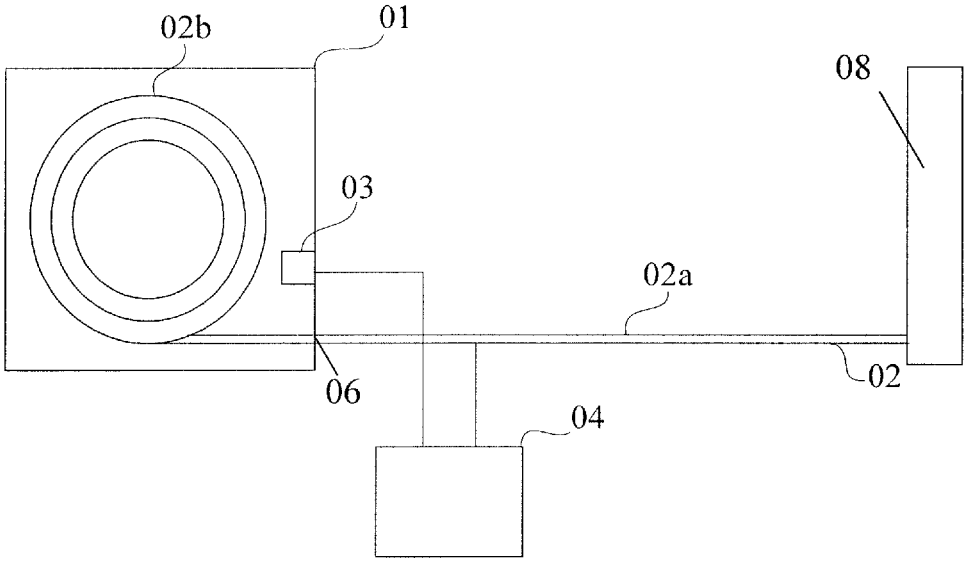
FIG. 1 is a schematic view of a display device according to an embodiment of the present invention.

The technical solution of the embodiments of the present disclosure will be described clearly and fully in connection with the drawings of the embodiments of the present disclosure. It is obvious that the described embodiments are just a part but not all of the embodiments of the present disclosure. Based on the described embodiments of the present disclosure, those skilled in the art can obtain all other embodiments without any inventive work, which all fall into the scope of the claimed disclosure.

Unless otherwise defined, technical terms or scientific terms used herein shall have a common meaning known by those skilled in the art of the present disclosure. Terms and expressions such as "first", "second" and the like used in the description and claims of the patent application of the present disclosure do not denote any sequence, quantity or importance, but distinguish different components. Likewise, words such as "a", "an" and the like do not denote quantitative restrictions, but denote the presence of at least one. Words such as "connected", "connecting" and the like are not restricted to physical or mechanical connections, but can include electrical connections, regardless of direct or indirect connections. Words such as "up", "below", "left", "right", etc., are only used to denote the relative positional relationship. Upon the absolute position of the described object changes, the relative positional relationship change correspondingly. Thicknesses and shapes of various layers of films in the drawings do not reflect the true scale, which are just for purposes of illustrating schematically the contents of the present invention.

FIG. 1 is a display device according to the first embodiment of the present invention. As shown in FIG. 1, the display device includes a housing 01 and a flexibility display panel 02 located inside the housing 01. The housing 01 can be a box having various geometric shapes and ventilation openings can be disposed on the box. Flexible display panel 02 is a display panel which is formed on a flexible substrate and can undergo bending deformation and still achieve display function. The flexible display panel 02 is wrapped when it is not in operation. The housing 01 has an outlet 06. During operation, the display panel 02 is pulled out from the outlet 06. As shown in FIG. 1, a portion of the flexible display panel 02 is pulled out from the housing 01. In this state, a region located outside the housing 01 is a front end region 02*a* of the flexible display panel 02, and a region located inside the housing 01 is a rear end region 02*b* of the flexible display panel 0. An extending direction from the front end region 02*a* to the rear end region 02*b* is a direction from front to rear of the flexible display panel 02. An end of the front end region 02*a* opposite to the rear end region 02*b* is connected with a cover 08. A direction in which the flexible display panel 02 is pulled out is a length direction of the display panel 02 such as a row direction, and a direction perpendicular to the direction in which the flexible display panel 02 is pulled out is a width direction of the display panel 02 such as a column direction.

The display device described above further includes a detection calculation unit 03 and a controller 04. The detection calculation unit 03 detects and calculates an area size of the front end region 02*a*, and the area size of the front end region 02*a* is output to the controller 04. The controller 04 is signally connected with the detection calculation unit 03 and the display panel 02. The controller 04 receives the area size of the front end region 02*a* output from the detection calculation unit 03, and controls only the front end region 02*a* in an active display state in which images are displayed.

By using a display device according to a first embodiment of the present invention, the detection calculation unit 03 can detect the area size of the front end region 02*a* of the flexible display panel 02 outside the housing 01, and the detected area information corresponding to the front end region 02*a* is output to the controller 04. The controller 04 controls only the flexible front end region 02*a* of the display panel 02 to display images based on the information, and controls the rear end region 02*b* of the flexible display panel 02 in a non-display state. In this case, the temperature of the rear end region 02*b* is low with less heat generation. Therefore the temperature within the housing 01 is low. Thus, the operation performance of the flexible the display panel 02 will not be affected or be less affected, such that the lifetime of the flexible display panel 02 will be lengthened.

During operation of the display device, since the rear end region of the flexible display panel 02 located inside the housing does not display images, the temperature of the region is low and very small amount of heat is generated, thus the temperature inside the housing is also low. Therefore, even if the rear end region of the flexible display panel is wrapped inside the housing, heat accumulation will not occur. The operation performance of the flexible display panel will be not deteriorated by heat accumulation, and the lifetime of the flexible display panel could be extended.

In the embodiment described above, the controller is signally connected with the detection calculation unit and the display panel. The "signally connected" herein includes connecting via signal lines and wireless signals.

Based on the display device described above, for the detection calculation unit detects the area of the front end region, the controller controls the display panel such that mark regions for example luminant regions for signal detection and non-mark regions for example non luminant regions are arranged alternatively along the direction from the front end region to the rear end region during operation. The mark regions and the non-mark regions have a total sum of at least three. That is, in this embodiment, the luminant region is formed on the display panel as the mark region, thereby the detection calculation unit determines the area size of the front end region by detecting the luminant region. The area size of the front end region is mainly determined based on the number of luminant regions detected by the detection calculation unit.

It is noted that the luminant regions in the present embodiment are used for detecting signals by the detection calculation unit and do not perform normal image display. The luminant region in the present embodiment includes active luminant region such as light emitting region, and passive luminant region such as reflective region under illumination. Correspondingly, the non-luminant region in the present embodiment includes a non-light emitting region separating active luminant regions, and a light transmissive region separating reflective luminant regions.

Figure 2A:
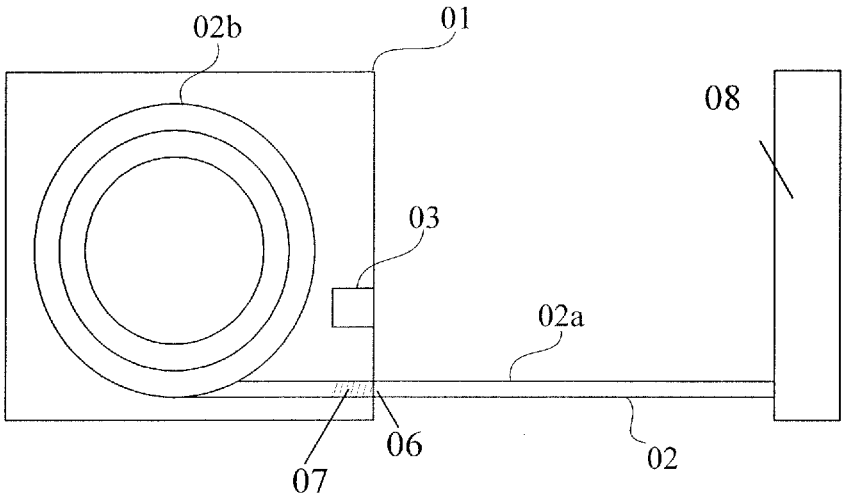
FIGS. 2A-2C are schematic views showing configuration states of the display device in FIG. 1.

The detection calculation unit determines the area of the front end region by detecting the number of the luminant regions. The non-luminant region divides the luminant regions into a plurality of discrete regions with a predetermined spacing. Specifically, as shown in FIG. 2A, the detection calculation unit 03 includes a light intensity detection unit (not shown) provided at the outlet 06. The light intensity detection unit detects the light intensity. The light intensity detection unit can be located inside the housing 01, or located outside the housing 01. When a luminant region 07 opposes the light intensity detection unit, the light intensity detection unit detects an optical signal from the luminant region 07, thereby the detection calculation unit 03 identifies that the luminant region 07 is at the outlet 06. The detection calculation unit 03 determines that the display surface region in front of the luminant region 07 is a front end region. At this point, the front end region does not include the luminant region 07 itself. The area information of the front end region is fed to the controller (not shown). When the flexible display panel 02 is further pulled out such that a non-luminant region adjacent to the luminant region 07 and located after the luminant region 07 opposes the light intensity detection unit, the light intensity detection unit detects an optical signal corresponding to the non-luminant region, thereby the detection calculation unit 03 keeps the area information of the front end region detected at the previous time.

In the present embodiment, the luminant regions can be configured as a plurality of discrete regions with a predetermined spacing, that is, the flexible display panel 02 includes a plurality of the luminant regions 07 at different positions so as to distinguish different sizes of the front end region 02 of the display panel which is pulled out from the housing 01. The luminant regions 07 located at different positions of the flexible display panel 02 indicate the front end regions 02*a* with different sizes which in turn corresponds to area information of different front end regions 02*a*. The detection calculation unit 03 obtains the area information of different front end regions by detecting the light emission regions located at different positions of the display panel. After each detection, the detection calculation unit 03 outputs the area information of the front end regions 02*a* to the controller. After receiving the area information of the front end regions 02*a* from the detection calculation unit 03, the controller will control pixels of the corresponding front end regions 02*a* to display image according to the area information of different front end regions 02*a*. The front end regions 02*a* can display a complete image being scaled down or a part of the complete image. At the same time, the controller controls the rear end regions 02*b* in an original state where images are not displayed. Temperature of the rear end region 02*a* as non-image display region is low, and very small amount of heat is generated, so that the temperature inside the housing 01 is also low.

In an embodiment of the present application, other types of regions or structures indicating the area of the front end regions 02*a* can be formed on the flexible display panel, which are not repeated herein.

In the present embodiment, the width of the luminant region 07 and the width of the non-luminant region are equal in a direction where the flexible display panel is pulled out so that a control strategy of the controller is relatively simpler.

Figure 2B:
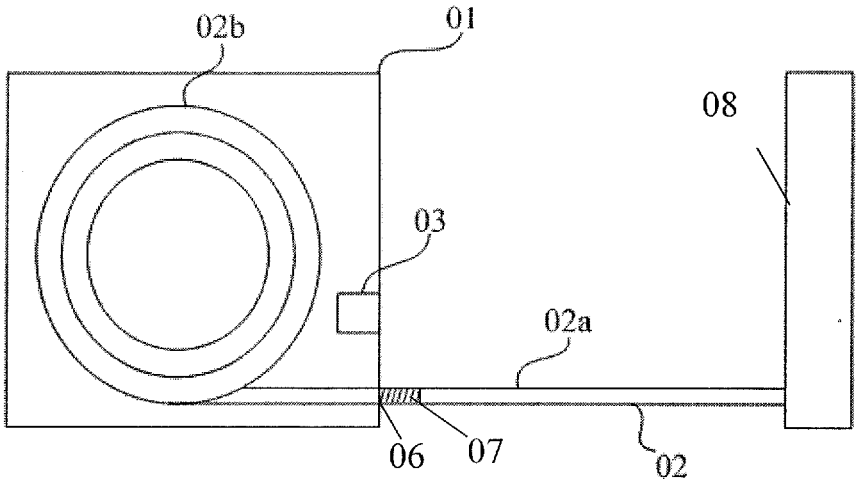

In some cases, as shown in FIG. 2B, due to space limitation, one of the luminant regions 07 on the flexible display panel 02 is outside the housing 01 after the flexible display panel 02 is pulled out from the outlet 06 of the housing 01. When the non-luminant region adjacent to the light-emitting region 07 is located at the outlet 06 and opposes the light intensity detection unit, the light intensity detection unit detects an optical signal corresponding to the non-luminant region. At this point, the detection calculation unit 03 keeps the area information of the front end region detected at the previous time, that is, the controller will not control to refresh the active display region of the enlarged front end region 02*a*. Therefore the luminant region 07 located outside the housing 01 and closest to the outlet 06 does not display images. In order to improve user experience, the width of the luminant region 07 which do not display images should be as smaller as possible. In the present embodiment, for this purpose, the width of the luminant region 07 is less than that of the non-luminant region in a case where the width of the luminant region 07 and the width of the non-luminant region adjacent have a constant sum value in the direction where the flexible display panel 02 is pulled out. Thus, the non-active display region on flexible display panel 02 outside the housing 01 will be relatively small, and user experience can be improved. In the present embodiment, the flexible display panel 02 is configured such that a region firstly pulled out from the outlet 06 is a non-luminant region, that is, the region of the flexible display panel 02 adjacent to the cover 08 is a non-luminant region. Before the flexible display panel 02 is further pulled out so that the second luminant region 07 opposes the light intensity detection unit, the area of the front end region 02*a* outside the housing 01 is the sum of the area of one luminant region 07 and the area of two non-luminant regions, rather than only one non-luminant region for displaying images.

Figure 2C:
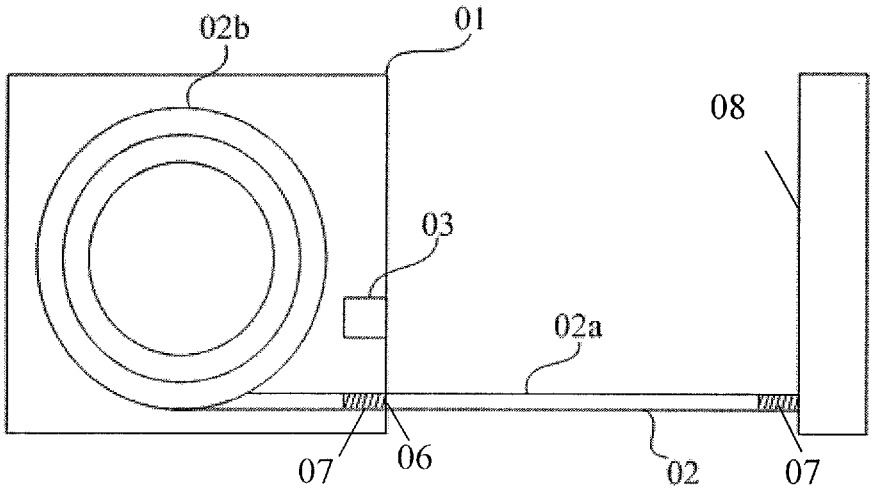

In order to further improve user experience, in another example of the present embodiment, the flexible display panel 02 can be configured such that a region firstly pulled out from said outlet 06 is a luminant region 07, that is, the region of the flexible display panel 02 adjacent to the cover 08 is the luminant region 07, as shown in FIG. 2C. In this embodiment, in a state where the second luminant region 07 opposes the light intensity detection unit, the area of the front end region 02*a* of the display panel 02 outside the housing 01 is the sum of the area of one luminant region 07 and the area of one non-luminant region, and both the one luminant region 07 and the one non-luminant region display images, therefore the display device configured according to the present example can improve user experience compared to the configuration of FIG. 2B.

In the embodiments described above, the flexible display panel 02 can include an active light emitting type display panel or a passive light emitting type display panel.

Figure 3:
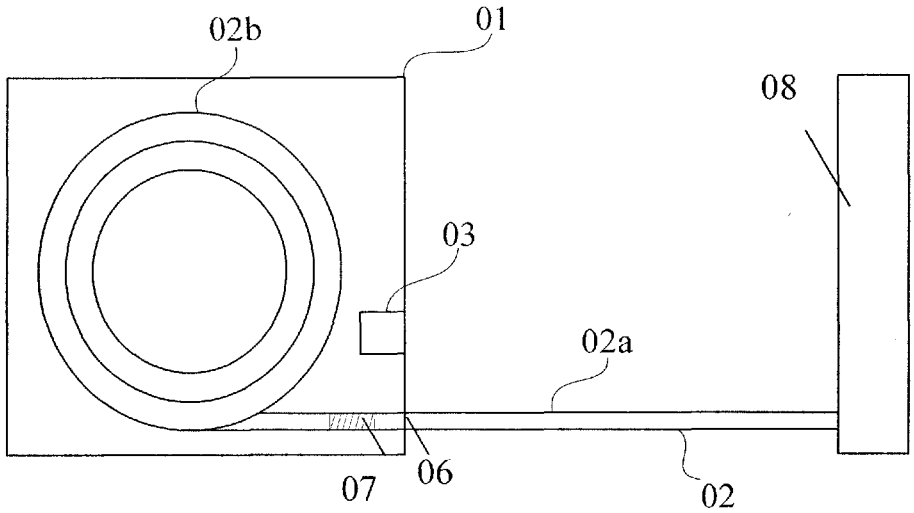
FIG. 3 is a schematic view of a configuration state of the display device in FIG. 1.
Figure 4:
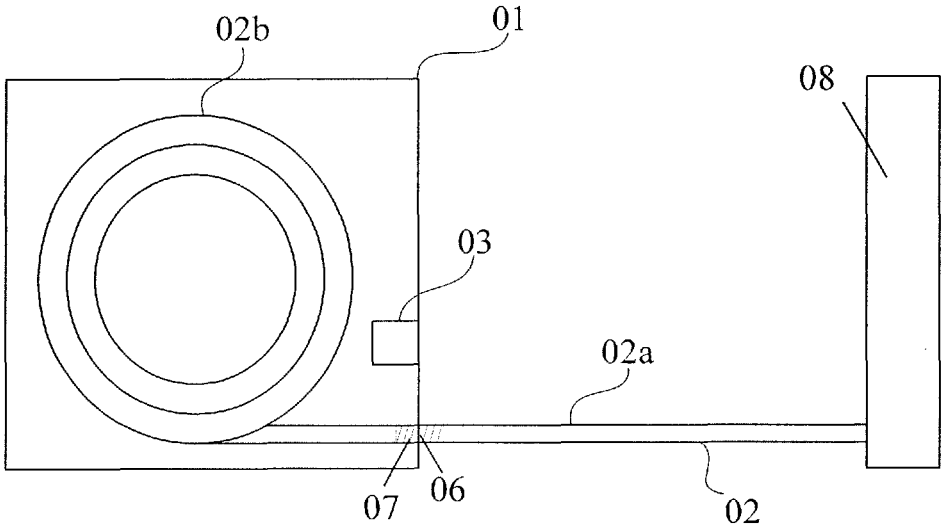
FIG. 4 is a schematic view of a configuration state of the display device in FIG. 1.

Specifically, the active light emitting type display panel can include an active matrix type active light emitting display panel which is driven in an active matrix driving mode, in which each pixel has only one TFT (Thin Film Transistor) or two, three TFTs. A part of regions of the panel can be controlled to emit lights to be luminant regions of the panel, without involving other regions on the panel. For example, in the present embodiment, the controller 04 controls a plurality of pixels corresponding to the luminant regions to emit lights having light intensity satisfying detection threshold of the light intensity detection unit via control circuits, without affecting other regions of the display panel. The luminant regions and the non-luminant regions can have any shapes, preferably regular shape such as rectangular, circular, oval and polygonal and so on. In a case where the light intensity of lights emitted from the plurality of the pixels in the luminant regions detected by the light intensity detection unit reaches the detection threshold of the light intensity detection unit, the detection calculation unit 03 identifies that the luminant region 07 detected by the light intensity detection unit is located at the outlet 06, and that display panel region in front of the luminant region 07 is the front end region 02*a*. The detection calculation unit 03 sends the area information of the front end region 02*a* to the controller 04. And in a case where the light intensity of lights emitted from the plurality of the pixels in the luminant regions detected by the light intensity detection unit does not reach the detection threshold of the light intensity detection unit, the detection calculation unit 03 identifies that the luminant region 07 is not located at the outlet 06, therefore the area information of the front end region 02*a* detected at the previous time is kept constant. For example, in both cases shown in FIG. 3 and FIG. 4, the luminant region 07 is not aligned perfectly with the light intensity detection unit included in the detection calculation unit 03, a portion of the lights emitted from the luminant region 07 is not received by the light intensity detection unit, and the light intensity detected by the light intensity detection unit does not reach the detection threshold thereof. At this point, the controller 04 will not update the area size of the front end region 02*a*. Thus the accuracy of the controller 04 can be improved, and only in a case where each of the luminant regions 07 opposes the light intensity detection unit included in the detection calculation unit 03, the controller 04 can control to refresh the active display region of the front end region 02*a*, for ensuring that the image displayed in the front end region 02*a* outside the housing 01 is continuously and stably refreshed during the display panel 02 is pulled out from the housing 01.

As an alternative and preferred manner, the active light emitting type display panel can further include a passive matrix type active light emitting display panel, which is driven in a passive matrix driving mode. In the embodiments of the present invention, the display panel in the passive matrix driving mode employs row scanning. The detection calculation unit 03 can be provided at a substantially central position in the width direction of the display panel 02. For ensuring that the detection calculation unit 03 can detect each luminant regions 07, in the present embodiment, the passive matrix driving mode is modified as column scanning, and the direction of column scanning is the direction from the front to the rear of the display panel. The controller 04 can control a part of the columns of the display panel 02 to be luminous as the luminant region 07, without involving other regions of the display panel.

Figure 5:
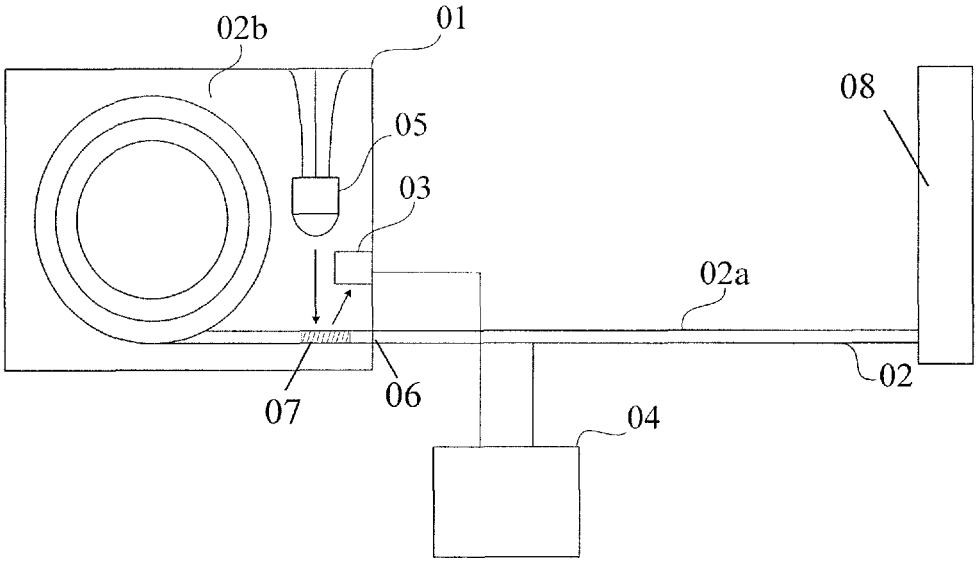
FIG. 5 is a schematic view of another display device according to an embodiment of the present invention.

In the embodiment of the present invention, the passive light emitting type display panel can include a cholesteric liquid crystal display panel in either an active matrix driving mode or a passive matrix driving mode. During operation, the controller 04 can control partial regions of the cholesteric liquid crystal display panel to be reflective regions, partial regions of that to be transmissive regions. At this point, the reflective regions function as the aforementioned luminant regions, and the transmissive regions function as the aforementioned non-luminant regions, and the driving mode of the reflective regions is the same as the active matrix driving mode and the passive matrix driving mode of the active light emitting type display panel. As shown in FIG. 5, the display panel 02 is a passive light emitting type display panel, and the display device further includes a light source 05 located inside the housing 01. The detection calculation unit 03 including the light intensity detection unit is also disposed inside the housing 01 to prevent ambient light from affecting the detection result. The light source 05 is disposed near the detection calculation unit 03. During operation, lights emitted by the light source 05 will be not incident directly into the light intensity detection unit, but on the display panel 02. The reflective region of the display panel 02 reflects lights from the light source 05, and the transmissive region of the display panel 02 transmits the lights from the light source 05, and the detection calculation process of the detection calculation unit 03 and the control of the controller 04 are the same as those of the active light emitting type display panel described above, which are not repeated herein.

Figure 8:
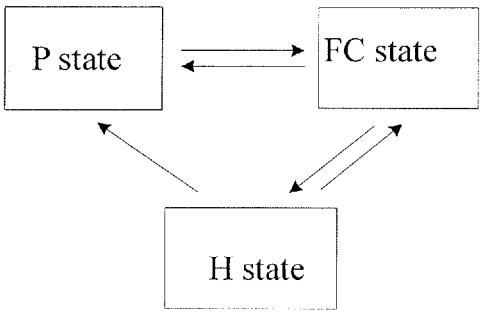
FIG. 8 is a schematic view of state transition of the cholesteric liquid crystal in the cholesteric liquid crystal display panel under different applied pressure in a case where the display panel in the display device is cholesteric liquid crystal display panel.

The characteristics of the cholesteric liquid crystal employed in the cholesteric liquid crystal display panel are briefly introduced herein. According to different voltages applied, states of the cholesteric liquid crystal can be classified into three forms, namely a planar texture (P state), focal conic texture (FC state) and homeotropic texture (H state). The P state cholesteric liquid crystal has a Bragg reflection characteristic capable of reflecting lights with a wavelength the same or similar as a pitch of a helical structure of the cholesteric liquid crystal helical structure. The FC state cholesteric liquid crystal presents a scattering effect. The H state cholesteric liquid crystal can transmit lights completely. FIG. 8 is a transition diagram among P state, FC state and H state of the cholesteric liquid crystal when different voltages are applied. As shown in FIG. 8, P state and FC state can be transformed to each other, and FC state and H state can be transformed to each other, while the transition between H state and P state is only from H state to P state. Specifically, the voltage applied to the P state liquid crystal is $V_P$, and the voltage applied to the FC state liquid crystal is $V_{FC}$, and the voltage applied to the H state liquid crystal is $V_H$. When $V_P>V_{FC}$, the P state liquid crystal is transformed to the FC state liquid crystal, and the transformation time is a few milliseconds. When $V_{FC}>V_H$, the FC state liquid crystal is transformed to the H state liquid crystal, and the transformation time is also a few milliseconds. The voltage $V_H$ applied to the H state liquid crystal is reduced rapidly, and the H state liquid crystal is transformed rapidly to the P state liquid crystal in less than 1 ms; whereas the voltage $V_H$ applied to the H state liquid crystal is reduced slowly, the H state liquid crystal is transformed rapidly to the FC state liquid crystal in a few milliseconds. In summary, the states of the cholesteric liquid crystal are different when external electric fields with different intensities are applied, that is, the helical structure of the cholesteric liquid crystal molecules is changed and the display panel exhibits different bright or dark states. In particular, when the cholesteric liquid crystal is P state, the helical axis of the liquid crystal molecules is substantially perpendicular to the substrate surface where the pixels of the display panel are located. At this time, if the pitch of the helical structure of the liquid crystal is similar or same as the wavelength of the incident lights to satisfy the Bragg reflection condition, the incident lights of the wavelength will be reflected, that is, the P state has Bragg reflection characteristic.

In the present embodiment, in a case where the display panel 02 is a cholesteric liquid crystal display panel, the controller 04 is enabled to control the liquid crystals of some regions in the display panel 02 to become the P state liquid crystals during operation, thus the regions are reflective regions, while control the liquid crystals of other regions separating the reflective regions to become the H state liquid crystals, thus the other regions become the transmissive regions. Lights from the light source 05 are irradiated on the reflection region 07, and the detection calculation unit 03 receives the lights reflected from the reflection region 07 of the liquid crystal panel to determine the front end region 02*a* of the display panel 02. If the lights from the light source 05 are irradiated on the transmissive region, the detection calculation unit 03 will not receive the lights from the light source 05. Thus, in the present embodiment, the function of the transmissive region is equivalent to the function of the non-luminant region in the active light emitting type display panel described above.

The cholesteric liquid crystal has a characteristic of selective wavelength of reflection. Accordingly, the wavelength of reflection of the cholesteric liquid crystal molecules is λ, and the average value of the birefringence is n, and the pitch is P, then the relationship among λ, n and P is:

$$\lambda=n\times P$$

Further, the wavelength of reflection has a bandwidth of:

$$\Delta\lambda=\Delta n\times P$$

where Δn is refractive index anisotropy, and the pitch is P=1/(HTP×Xc), where Xc is concentration of the chiral agent, and HTP is twisting force constant of the chiral agent, the concentration of the chiral agent and the twisting force constant of the chiral agent are depended on the characteristics of chiral molecules themselves.

It can be seen according to the formula above, in the present embodiment including the cholesteric liquid crystal display panel, the wavelength of reflection λ of the cholesteric liquid crystal can be adjusted by adjusting the pitch P of the liquid crystal molecules. That is, the wavelength range of the lights emitted by the light source is large. Even if the display device can include light sources emitting lights with different wavelengths, by adjusting the pitch of the liquid crystal molecules in the liquid crystal display panel so that it is similar or the same as the wavelength of the lights from the light source, the reflection regions can be luminous thereby the detection calculation unit 03 detects the front end region 02*a* to improve the robustness of the display device.

Preferably, the detection calculation unit 03 is disposed inside the housing 01 for easy carrying in a condition for satisfying operation requirements. Therefore, this can prevent the ambient lights outside the housing 01 from interfering with detection results of the detection calculation unit 03, and prevent the detection calculation unit 03 from erroneous detection and feeding back erroneous signals to the controller 04. However, during the operation of the device, the controller 04 will generate a small amount of heat. And because of poor ventilation inside the housing 01, if the controller 04 is placed inside the housing 01, the operational performance and lifetime of the controller 04 will be affected. Therefore, the controller 04 is disposed outside the housing 01.

Further, in order to enable the processes for the detection calculation unit detecting and determining the front end region of the display panel and the controller controlling the display process of the front end region to progress successively, the controller also controls the (N+1)th luminant region after the Nth luminant region luminous while the detection calculation unit determines that the display panel region in front of the Nth luminant region is the front end region. Thus, the user can pull the display panel to a desired size for viewing at any time during operation.

Preferably, in the display device, the controller is configured to control at most two luminant regions in the luminous state. Alternatively, the controller is configured to control all luminant regions on the display panel in the luminant state after the display device is just powered on for simplifying the operation of the controller. Here, as described above, the luminant regions on the display panel will not display images normally in the luminant state, and the luminant regions on the display panel will display images normally when they are not in the luminant state.

Figure 6:
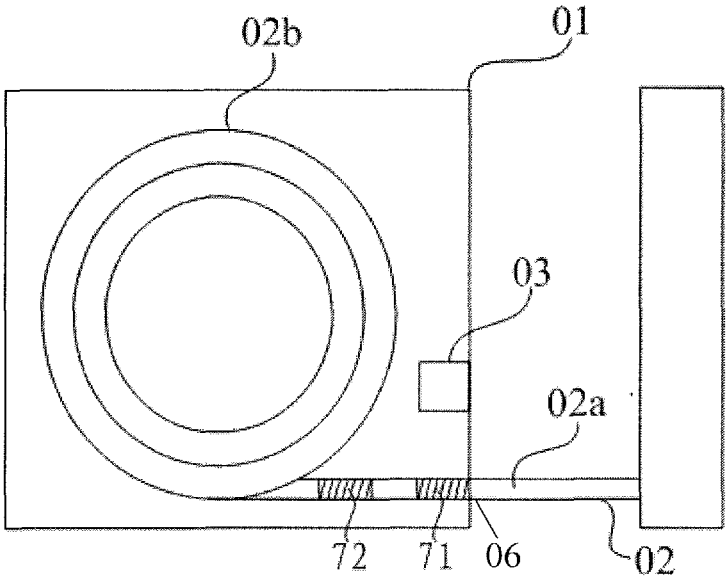
FIG. 6 and FIG. 7 are schematic views of configuration states of the display device according to the embodiments of the present invention.
Figure 7:
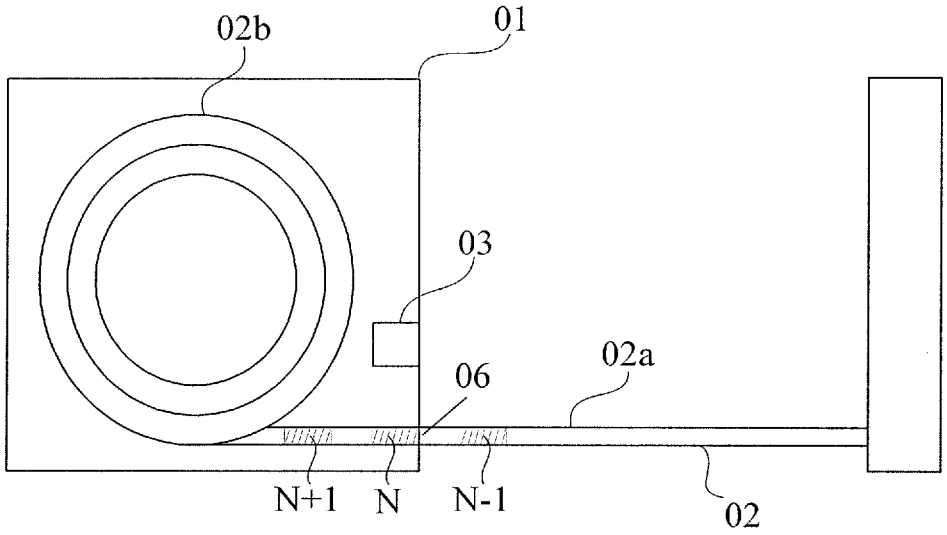

If the controller controls at most two luminant regions in the luminant state, the display device is configured as follows. For example, as shown in FIG. 6, when the display device described above is just powered on, the controller sends signals to control the first luminant region 71 and the second luminant region 72 on the display panel to be luminant. Since when the first luminant region 71 is luminant, the detection calculation unit receives an optical signal of the first luminant region 71 and determines that the region in front of the first luminant region 71 is the front end region, while the area information of this front end region is fed back to the controller. The controller then controls the second luminant region 72 to be luminant. The display panel 02 is pulled out continually from the housing 01, and the first luminant region 71 and a first non-luminant region are located outside the housing when the second luminant region 72 is aligned with the detection calculation unit 03. The controller controls the front end region including the first luminant region 71 and the first non-luminant region in front of the second luminant region 72 to re-display images, and the controller controls a third luminant region to be luminant. At this point, only the second and third luminant regions are luminant. By such analogy, as shown in FIG. 7, a (N−1)th luminant region (N−1) and a (N−1) non-luminant region are pulled out from the housing 01 when a Nth luminant region N is aligned with the detection calculation 03. The controller controls the front end region in front of the Nth luminant region N to display images, and the controller controls a (N−1) luminant region (N+1) to be luminant. Therefore, each time after the detection calculating unit 03 detects the front end region 02*a* and feeds the information of the front end region 02*a* of the information back to the controller, the controller controls the next luminant region to be luminant, and the controller is configured to control at most two luminant regions to be luminant.

If the controller controls all luminant regions t in the luminant state, the display device is configured as follows. When the display device described above os just powered on, the controller sends signals to control all luminant regions on the display panel to be luminant. When the first luminant region is luminant, the detection calculation unit receives an optical signal of the first luminant region and determines that the region in front of the first luminant region is the front end region, while the area information of this front end region is fed back to the controller. The controller then controls the front end region in front of the first luminant region to display images. The display panel continues to be pulled out from the housing, and the detection calculation unit receives an optical signal of the second luminant region and determines that the region in front of the second luminant region is the front end region, while the area information of this front end region is fed back to the controller, then the controller controls the front end region in front of the second luminant region to display images. Thus, when the Nth luminant region N is aligned with the detection calculation unit, the controller controls the front end region in front of the Nth luminant region N to display images so as to simplify the control strategy of the controller.

The above embodiments are only for illustrating the present disclosure, and not intended to limit the present disclosure. Those skilled in the art can make various variations and modifications without departing from the spirit and scope of the present disclosure, so all equivalent technical solutions also fall into the scope of the present disclosure. It is intended that the scope of the present disclosure should be defined by the claims appended.

What is claimed is:

1. A display device, comprising:

a housing having an outlet;

a flexible display panel located inside the housing, wherein at least a portion of the flexible display panel can be pulled out from the outlet, and in a case where the flexible display panel is pulled out, a region located outside the housing is a front end region of the flexible display panel, and a region located inside the housing is a rear end region of the flexible display panel, an extending direction from the front end region to the rear end region is a direction from front to rear of the flexible display panel;

a detection calculation unit configured to detect and calculate an area of the front end region; and a controller signally connected with the detection calculation unit and the flexible display panel, and configured to receive the area of the front end region output from the detection calculation unit and control only the front end region displaying images;

wherein the flexible display panel includes at least one discrete mark region disposed along the direction from front to rear of the flexible display panel; and the mark region is at least one luminant region formed on the flexible display panel by control of the controller, and the luminant regions and non-luminant regions separating the luminant regions have a total number of at least three;

wherein a width of the luminant region is smaller than a width of the non-luminant region in the direction from front to rear of the flexible display panel in a case where the width of the luminant region and the width of the non-luminant region abutting the luminant region have a constant sum.

2. The display device according to claim 1, wherein the detection calculation unit includes a detection unit disposed at the outlet, and the detection calculation unit determines the area of the front end region according to a number of the mark regions detected by the detection unit.

3. The display device according to claim 2, wherein, the detection unit is a light intensity detection unit configured to detect an intensity of light.

4. The display device according to claim 3, wherein in a case where an Nth luminant region opposes the light intensity detection unit directly, the light intensity detection unit detects an optical signal of the Nth luminant region, the detection calculation unit determines that the Nth luminant region is located at the outlet, and the detection calculation unit determines that a flexible display panel region in front of the Nth luminant region is the front end region, and feeds area information of the front end region to the controller;

in a case where an Nth non-luminant region opposes the light intensity detection unit directly, the light intensity detection unit detects an optical signal corresponding to the Nth non-luminant region, the detection calculation unit determines that the Nth non-luminant region is located at the outlet, and the detection calculation unit keeps the area information of the front end region detected at a previous time;

where N is a positive integer.

5. The display device according to claim 4, wherein a region of the flexible display panel pulled out from the outlet firstly is the luminant region.

6. The display device according to claim 4, wherein the flexible display panel is an active light emitting type flexible display panel or a passive light emitting type flexible display panel.

7. The display device according to claim 4, wherein the flexible display panel is a passive matrix type flexible display panel with a column scanning mode.

8. The display device according to claim 1, wherein a region of the flexible display panel pulled out from the outlet firstly is the luminant region.

9. The display device according to claim 1, wherein the flexible display panel is an active light emitting type flexible display panel or a passive light emitting type flexible display panel.

10. The display device according to claim 9, wherein the flexible display panel is the passive light emitting type flexible display panel, and the display device further includes a light source disposed near the light intensity detection unit and emitting lights which are not incident onto the light intensity detection unit directly, and the luminant region reflects the lights from the light source, and the non-luminant region transmits the lights from the light source.

11. The display device according to claim 1, wherein the flexible display panel is a passive matrix type flexible display panel with a column scanning mode.

12. The display device according to claim 1, wherein the detection calculation unit is located inside the housing, and the controller is located outside the housing.

13. The display device according to claim 1, wherein in a case where the detection calculation unit determines that a region of the flexible display panel in front of the Nth luminant region is the front end region, the controller further controls a (N+1)th luminant region after the Nth luminant region to be luminant.

14. The display device according to claim 13, wherein the controller is configured to control at most two luminant regions in a luminant state.

15. The display device according to claim 14, wherein in a case where the detection calculation unit determines that the region of the flexible display panel in front of the Nth luminant region is the front end region, the controller is configured to control only the Nth luminant region and the (N+1)th luminant region after the Nth luminant region to be luminant.

16. The display device according to claim 13, wherein the controller is configured to control all the luminant regions on the flexible display panel in a luminant state when the display device has been just powered on.

* * * * *